United States Patent [19]

Zafred

[11] Patent Number: 4,738,119

[45] Date of Patent: Apr. 19, 1988

[54] INTEGRAL COOLING GARMENT FOR PROTECTION AGAINST HEAT STRESS

[75] Inventor: Paolo R. Zafred, Pittsburgh, Pa.

[73] Assignee: Westinghouse Electric Corp., Pittsburgh, Pa.

[21] Appl. No.: 12,777

[22] Filed: Feb. 9, 1987

[51] Int. Cl.[4] ..... F25D 23/12; A61N 00/00

[52] U.S. Cl. ..... 62/259.3; 128/379; 128/400; 2/81

[58] Field of Search ..... 2/DIG. 2, DIG. 7, 81; 62/259.3, 384, 385, 388; 128/379, 380, 386, 399, 400, 385; 165/46

[56] References Cited

U.S. PATENT DOCUMENTS

| | | | |
|---|---|---|---|
| 546,436 | 9/1895 | Springsteen . | |
| 2,493,759 | 1/1950 | Freygang | 128/403 |
| 3,000,190 | 9/1961 | Stark | 62/259 |
| 3,411,156 | 3/1965 | Feher | 2/81 |
| 3,610,323 | 10/1971 | Troyer | 165/46 |
| 3,612,059 | 10/1971 | Ersek | 128/399 |
| 3,738,367 | 6/1973 | Hardy | 128/379 |
| 3,802,215 | 4/1974 | Rowe | 62/384 |
| 3,922,878 | 12/1975 | Jalali | 62/384 |
| 3,950,789 | 4/1976 | Konz et al. | 128/379 |
| 4,118,946 | 6/1978 | Tubin | 62/514 |
| 4,172,454 | 10/1979 | Warncke et al. | 128/142.5 |

FOREIGN PATENT DOCUMENTS

| | | | |
|---|---|---|---|
| 240671 | 11/1986 | German Democratic Rep. | 62/259.3 |

*Primary Examiner*—Richard C. Pinkham
*Assistant Examiner*—Mark S. Graham
*Attorney, Agent, or Firm*—L. P. Johns

[57] ABSTRACT

An integral cooling garment for protection against heat stress characterized by a pair of separate linings stitched together to form tube-receiving chambers which microporous tubes are detachably connectable to a source of liquid carbon dioxide which converts to a solid phase and then gradually sublimates to carbon dioxide gas that is released into the chambers for cooling a wearer of the article of clothing, and the article being untethered to the source of liquid carbon dioxide when worn.

6 Claims, 1 Drawing Sheet

INTEGRAL COOLING GARMENT FOR PROTECTION AGAINST HEAT STRESS

BACKGROUND OF THE INVENTION

1. Field of the Invention

This invention pertains to a personal cooling system and, more particularly, it pertains to an article of clothing to protect a person from extreme temperature and humidity conditions which may exist in a work environment.

2. Description of the Prior Art

Extreme temperature conditions are a major cause of human inability to concentrate and remain alert, and consequently are a common cause of industrial accidents and injuries. In hot environments workers are exposed to heat stress as a result of performing heavy work tasks. Heat stress may be prevented either by reducing heat flow into the body (cooling surrounding air is a customary method) or by increasing heat loss from the body. When it is impractical to cool the environment, body heat loss can be effectively increased through the utilization of a personal cooling garment.

In the past several personal cooling garments have been developed to reduce workers heat stress exposure. Such garments include circulating air systems, ice cooling devices, and circulating liquid systems. The circulating air system is a one piece impermeable suit with inner air distribution lines and a vortex tube. When connected to supplied air at 80–100 psi, cooled air flows through the suit, thus removing excess body heat. A major disadvantage is that this device requires between 15 and 25 CFM of air in order to deliver 5 CFM of cooled air to the person. This requires air compressors and therefore capital and running costs are involved. In addition, the vortex tube produces noise levels well in excess of 100 dB and, workers are tethered to the air supply via an umbilical cord which restricts mobility and the ability to pass through and work in confined spaces.

Ice cooling devices are garments containing about 50 small packets of ice which absorb the metabolic heat produced by the human body. The cooling capacity of the ice cooling garment is determined by the amount of ice contained in the garment. For practical purposes this amount is limited to 10–12 pounds of ice. Freezing and storage of the ice packets requires approximately 8 to 10 hours by utilizing a high capacity freezer located close to the changing area. Once the ice packets are removed from the freezer and placed in the garment, they begin to absorb heat. Therefore, donning the garment must be delayed to the last moment to prevent partial ice melting and therefore reduction in the cooling capacity of the garment.

Circulating liquid systems utilize a heat sink or reservoir containing water, ice, a pump generally powered by batteries, and a heat exchanger. Cool water is circulated in a closed system through tubes within the skin where it absorbs heat and then through the heat exchanger which is in contact with the heat sink. The heat sink normally worn as a back-pack may weigh 22 pounds or more, depending upon design. Its weight and size impose considerable restrictions upon the wearer, such as the size of a passageway that can be entered. In addition, facilities are required for storage and production of the heat sinks. Accordingly, consideration of the above factors results in conventional personal cooling garments being impractical or not applicable to heat stress relief of many workers.

SUMMARY OF THE INVENTION

An integral cooling garment for the protection of a person's body from ambient heat, comprising an outer lining, an inner lining, and a plurality of cooling tubes therebetween; each lining including a first layer of insulating material, the outer lining also including a second layer of reflective material to reflect ambient radiant heat away from the lining; the inner lining also including a second layer of reinforcement fabric for the first insulating layer; the inner and outer linings forming an intermediate compartment and the inner and outer linings being stitched together at spaced intervals to form tube-containing chambers of the compartment; a container for containing liquid carbon dioxide and comprising an outer valve; the tubes having a nozzle connection detachably connected to the valve for delivering fluidized carbon dioxide to the tubes where the carbon dioxide converts to solid carbon dioxide and where it then sublimates to carbon dioxide gas; the tubes also being microporous for containing the solid carbon dioxide and for releasing carbon dioxide gas into and the garment being useful without continuous connection to the container.

The advantage of the device of this invention is that liquified carbon dioxide is delivered to the garment under high pressure into cooling tubes of a microporous structure through which gaseous carbon dioxide flows for convective and conductive cooling of the wearer. In addition, the garment is used during sublimation of the carbon dioxide without being tethered to the source of liquified carbon dioxide.

DESCRIPTION OF THE PREFERRED EMBODIMENT

Figure 1:
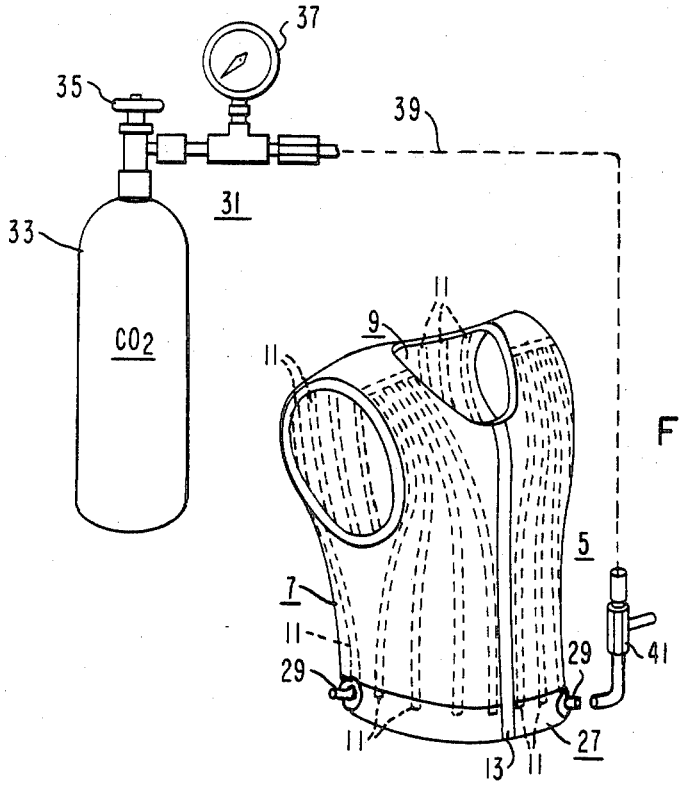
FIG. 1 is an isometric view of the cooling garment, showing the manner in which it is detachably connected to a source of carbon dioxide.

In FIG. 1 an article of clothing or vest is generally indicated at 5. Although a vest is shown it is understood that any other type of clothing, such as a jacket, coat, trousers, coverall, or pads may be involved. The vest 5 comprises outer and inner linings 7, 9 (Figure 2) with gas conducting conduits or tubes 11 therebetween. A fastener 13 is provided on the front center of the vest 5 for holding the vest tightly in place against the body of the wearer.

The outer lining 7 is comprised of two layers of insulating material including an outer layer 15 and an inner layer 17. The outer layer 15 preferably comprises of a reflective material for reflecting ambient radiant heat from external sources for extra protection. For example, the outer layer 15 may be comprised of an outer thin skin of aluminized coating bonded to a support fabric. The outer layer 15 is commercially available under the trademark "Thermal/R". The inner layer 17 is comprised of an insulating material.

The inner lining 9 likewise includes an inner layer 19 of insulating material similar to the inner layer 17 of the outer garment 7. Both inner layers 17, 19 perform a heat insulating function. A suitable material for the inner layers 17, 19 is sold under the trademark "Thinsulate"

which is a 60% polyolefin, and 40% polyester fiber. The inner lining 9 also includes an outer layer 21 of material, such as stretch-nylon, for reinforcing the inner layer 19.

Figure 2:
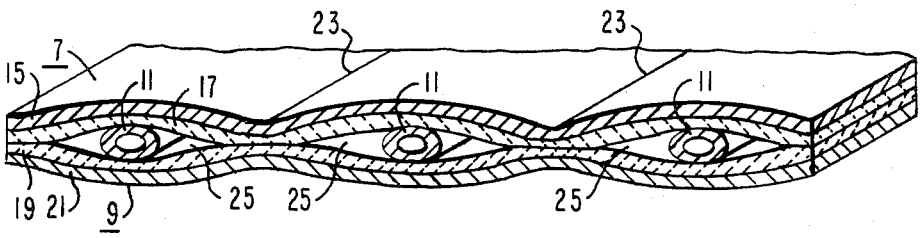
FIG. 2 is a fragmentary isometric view of a section through the cooling garment.

As shown in FIGS. 1 and 2 the outer and inner linings 7, 9 are sewn together with stitching 23 (FIG. 2) at spaced intervals for dividing a compartment between the garments into adjacent chambers 25, in each of which a tube 11 is disposed. The spaced stitches 23 provide means for retaining the tubes 11 in spaced relation with respect to each other.

The tubes 11 are microporous tubing having a predetermined mesh size to ensure required permeability. The tubes 11 are preferably comprised of polytetrafluorethylene, such as Teflon, with microscopic pores sufficiently small to contain a solid, but large enough to allow gas to escape. One end of each tube 11 is closed and the other end communicates with a manifold 27 which in turn communicates with hose coupling 29.

In accordance with this invention the vest 5 functions as a cooling system for a person wearing it by the injection of liquified carbon dioxide in the tubes 11. For that purpose a pressurized gas system 31 is provided for periodically filling the tubes 11 with fluidized carbon dioxide. The system 31 includes a cylinder 33 having a regulator valve 35 and a pressure gauge 37. A hose or conduit 39 extends from the gauge to a hose coupling 41 and the coupling 29.

In operation, the vest 5 is prepared for use by introducing liquified carbon dioxide ($CO_2$) from the cylinder or tank 33 until the tubes 11 are filled with solid carbon dioxide (dry ice). The system 31 is then disconnected from the hose coupling 29 at the valve 41.

When the liquified carbon dioxide is ejected into the several tubes 11, through the valve 41, it expands and converts into a mixture of 40% solid dry ice ($CO_2$) and 60% gas, the expansion occurring adiabatically. Subsequently, during the use of the vest 5, the solid dry ice within the tubes sublimates to gaseous carbon dioxide which in turn is released from the tubes 11 through the microporous structure of the tube. Thus, the carbon dioxide gas is disseminated into the chambers 25 and from there through the permeable inner garment 9 into contact with the person wearing the vest 5, thereby maintaining a comfortable temperature for the wearer who is in an abnormally warm to hot atmosphere.

Use of the vest 5 is not a continuous operation and does not require the wearer to be tethered to the gas system 31. When the tubes 11 are filled with carbon dioxide and sublimation thereof commences, the vest may be worn from 5 to 6 hours depending upon how much solid carbon dioxide (dry ice) has been injected within the tubes. The time depends upon the ambient temperature, the metabolic heat of the wearer's body, and the radiant heat from external sources. When the solid carbon dioxide within the tubes 11 completely sublimates, the vest may be recharged without removal by simply reattaching the nozzle 41 to one of the garment couplings 29.

The advantage of the use of liquid carbon dioxide for introduction into the tubes 11 is that after forming solid carbon dioxide within the tubes it gradually sublimates thus reducing the weight of the cooling garment. As soon as the carbon dioxide completely sublimates, and the refrigeration effect is completed the vest may be recharged. A concomitant advantage of the foregoing is that during use the vest is not tethered to the source of carbon dioxide. Once the vest is fully charged the tubes contain the sublimation process of the production of gaseous carbon dioxide for the benefit of the user.

In conclusion, the device of this invention provides a personal cooling system which is essentially operated really by way of opening a valve on the carbon dioxide cylinder. Finally, the vest is not tethered to the source of the coolant. Once the liquified carbon dioxide is delivered to the garment via the high pressure hose and a nozzle the charged carbon dioxide is ready to perform free of the gas system 31.

What is claimed is:

1. An integral cooling garment for the protection of a person's body from ambient heat, comprising:

an outer lining, a permeable inner lining, and a plurality of gas-conductivity tubes therebetween;

each lining including a first layer of insulating material;

a container for containing fluidized carbon dioxide and comprising a pressure reducing valve;

said tubes having a nozzle detachably connected to the valve for delivering liquified carbon dioxide to the tubes where the liquified carbon dioxide converts to solid carbon dioxide and where it then sublimates to carbon dioxide gas;

the tubes also being microporous of a predetermined pore size for releasing carbon dioxide gas into the areas between the inner and outer linings and through the inner lining into contact with a person's body, whereby the article of clothing is useful without continuous connection to the container during sublimation of the solid carbon dioxide.

2. The device of claim 1 in which the inner and outer linings form an intermediate compartment in which the tubes are disposed.

3. The device of claim 2 in which the inner and outer linings are stitched together at spaced intervals to form tube-containing chambers.

4. The device of claim 3 in which the outer lining indicates a second layer of material to reflect ambient radiant heat from the garment.

5. The device of claim 4 in which the inner lining includes a second layer of reinforcement fabric for the first insulating layer.

6. The device of claim 1 in which one end of each tube is connected to a common manifold.

* * * * *